US009428310B2

(12) United States Patent
White et al.

(10) Patent No.: US 9,428,310 B2
(45) Date of Patent: Aug. 30, 2016

(54) COVER FOR OPEN TOP FOOD CONTAINERS

(71) Applicant: Donna M. White, Claymont, DE (US)

(72) Inventors: Donna M. White, Claymont, DE (US); James K. Finney, New Castle, DE (US); Charles D. Hunt, Claymont, DE (US)

( * ) Notice: Subject to any disclaimer, the term of this patent is extended or adjusted under 35 U.S.C. 154(b) by 0 days.

(21) Appl. No.: 14/524,209

(22) Filed: Oct. 27, 2014

(65) Prior Publication Data

US 2016/0114941 A1 Apr. 28, 2016

(51) Int. Cl.
*B65D 43/02* (2006.01)
*B65D 43/20* (2006.01)

(52) U.S. Cl.
CPC ..... *B65D 43/0202* (2013.01); *B65D 43/20* (2013.01); *B65D 2543/0037* (2013.01)

(58) Field of Classification Search
CPC .. B65D 43/0202; B65D 43/02; B65D 43/20; B65D 43/12; B65F 1/1607; B65F 1/1615; B65F 1/16; A45C 13/16
USPC ..... 220/908, 212.5, 212, 254.9, 254.3, 220/254.1, 259.5, 259.1, 256.1, 230, 345.2, 220/350, 351, 345.4, 345.1, 812, 811, 810, 220/200
See application file for complete search history.

(56) References Cited

U.S. PATENT DOCUMENTS 2,099,122 A * 11/1937 Kreisler ..... A45C 13/16 132/303
2,118,099 A 5/1938 Mirk
2,593,190 A * 4/1952 Robin ..... A45C 11/34 206/816
2,739,730 A * 3/1956 Irving ..... B65F 1/1484 160/201
2,820,513 A 1/1958 Drakoff
4,190,191 A 2/1980 Forbes, Jr.
4,360,148 A 11/1982 Forbes, Jr.
4,463,893 A 8/1984 Brunone et al.
4,819,829 A 4/1989 Rosten et al.

(Continued)

OTHER PUBLICATIONS

Cambro, retrieved on Jul. 10, 2014 from, http://www.katom.com/144-1218SCCW135.html?CID=Shopzilla&utm_source=Shopzilla&utm_medium=CSE&utm_campaign=CSE&zmam=29342707&zmas=1&zmac=26&zmap=144-1218SCCW135.

(Continued)

*Primary Examiner* — Robert J Hicks
(74) *Attorney, Agent, or Firm* — Drinker Biddle & Reath LLP

(57) ABSTRACT

A cover for open top food containers includes a peripheral side wall which can telescope over one or more of the containers. An inner frame is mounted inwardly of the inner surface of the side wall for being disposed on the upper edge of the container. A fan/accordion type lid is mounted on side supports above the inner frame to selectively be moved to extended and retracted conditions. When the lid is in its extended condition access to the food container is closed. When the lid is in its retracted condition there is access to the food container.

14 Claims, 7 Drawing Sheets

(56) References Cited

U.S. PATENT DOCUMENTS

| | | | | |
|---|---|---|---|---|
| 5,088,750 | A * | 2/1992 | Beese | B65F 1/02 220/908 |
| 5,118,005 | A * | 6/1992 | Onodera | B65F 1/004 220/501 |
| 5,355,789 | A * | 10/1994 | Suzuki | B30B 9/3021 100/211 |
| 5,657,894 | A * | 8/1997 | Bowen | B65D 43/169 220/254.3 |
| 6,131,758 | A | 10/2000 | Callahan et al. | |
| 6,199,493 | B1 * | 3/2001 | Kiss | B09B 3/00 110/186 |
| 6,540,098 | B1 | 4/2003 | Jarvis et al. | |
| 7,419,057 | B2 | 9/2008 | Avery | |
| 8,925,761 | B2 | 1/2015 | Jack | |
| 2002/0005424 | A1 * | 1/2002 | Lange | B60R 7/04 224/539 |
| 2002/0070220 | A1 * | 6/2002 | Kuehn | B65D 43/20 220/350 |
| 2008/0110895 | A1 * | 5/2008 | Baptiste | B65F 1/16 220/345.1 |
| 2009/0289067 | A1 * | 11/2009 | Baptiste | B65F 1/16 220/345.1 |
| 2012/0043323 | A1 | 2/2012 | Thomas et al. | |
| 2013/0026166 | A1 * | 1/2013 | Stone | B65F 1/1607 220/212 |

OTHER PUBLICATIONS

Mirro. retrieved on Jul. 10, 2014 from, http://www.ebay.com/itm/MIRRO-8-X-8-X-2-CAKE-PAN-WITH-SLIDING-LID-USA-/301235159889?pt=LH_DefaultDomain_0&hash=item462303c351#ht_416wt_868.

Carlisle retrieved on Jul. 10, 2014, from http://www.webstaurantstore.com/forest-green-carlisle-xt160008-cateraide-slide-n-seal-20-x-12-x-6-insulated-food-pan-carrier-with-sliding-lid/271X71600FG.html.

Krowne, retrieved on Jul. 10, 2014 from http://www.culinarydepotinc.com/p-114873-krowne-c-41-partial-sliding-ice-bin-cover.aspx?utm_source=Google&utm_medium=CSE&utm_term=114873&utm_camPaign=Krowne&gdftrk=gdfV23516_a_7c1516_a_7c7146_a_7c114873&gclid=CNa01Yq8ur8CFQKLaQodWxgAHg.

* cited by examiner

COVER FOR OPEN TOP FOOD CONTAINERS

BACKGROUND OF INVENTION

Open top food containers are commonly used at cookouts, parties, social gatherings and the like. One of the concerns, particularly in outdoor use, is that flying insects and germs swarm around the food in the picnic area. These flies and insects carry disease that can easily be transferred to unprotected foods. A further problem with open top containers is the prevention of germs and bacteria reaching the food from individuals coughing and sneezing which can contaminate the food. It is also a concern to keep the foods warm for a long period of time. One common approach is to cover the open top containers with foil. Traditional foil, however, does not provide a sufficient cover of the foods and does not effectively prevent flies and other insects from entering the food containers.

SUMMARY OF INVENTION

An object of this invention is to provide a cover for an open top food container, particularly one that could be used at cookouts, picnics and other outdoor events.

A further object of this invention is to protect food items from flying insects and germs and to protect the food items from germs and bacteria from individuals coughing and sneezing.

In accordance with this invention the cover includes a peripheral side wall which can fit over one or more open top food containers. The top of the cover has an opening to provide ready access to the food within the food containers. The opening is selectively closed by a fan or accordion type lid which is anchored at one end and can slide to the other end to completely cover the opening.

Preferably, the cover includes an inner frame which would rest on the open top food container upper rim. The lid preferably slides on a pair of side supports located above the inner frame. The lid could be held in its closed position in any suitable manner, such as by a latch or by magnets.

THE DRAWINGS

DETAILED DESCRIPTION

Figure 1:
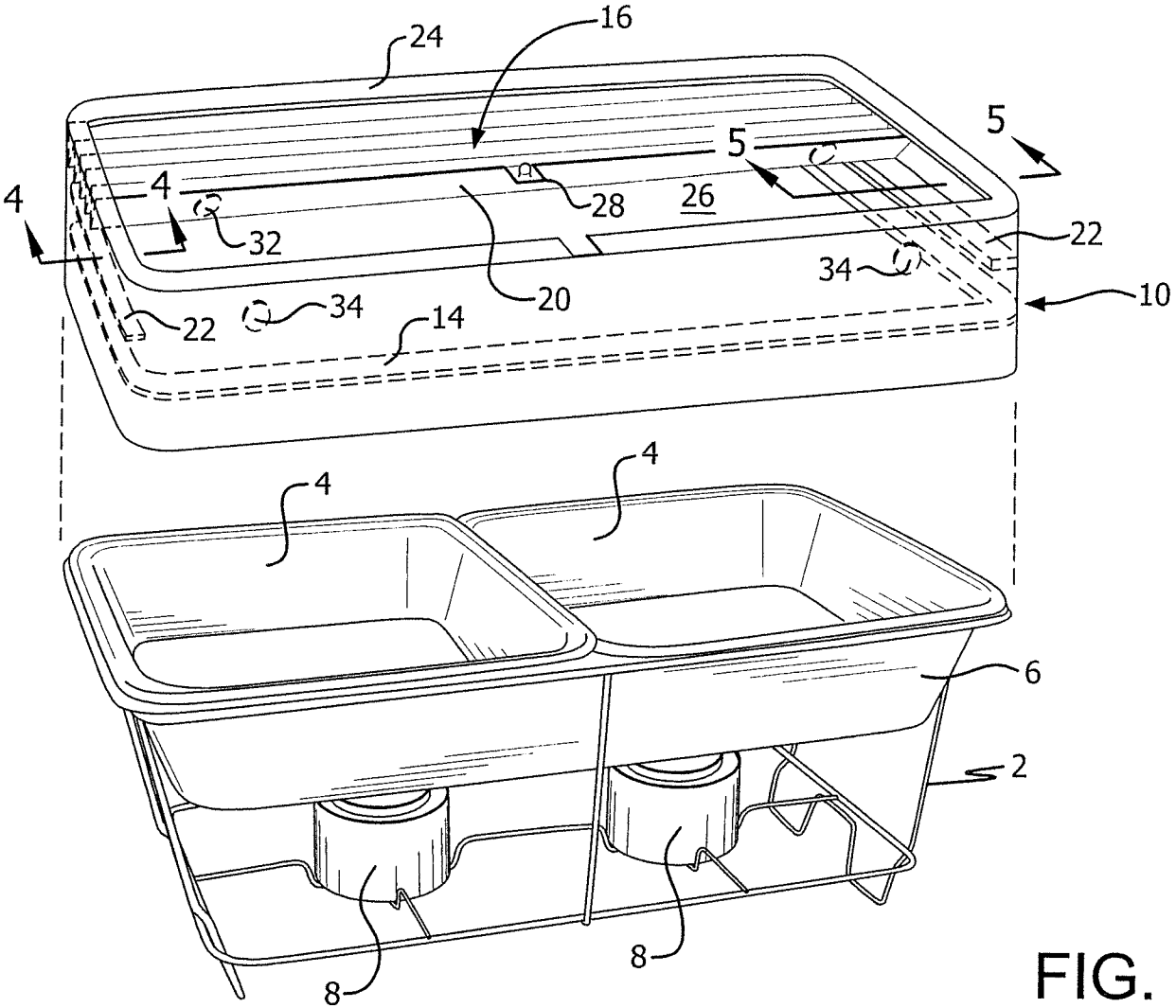
FIG. 1 is an exploded view showing a cover of this invention disposed over open top containers at a cookout.

The present invention relates to a food container cover and in particularly a cover which includes a unique lid that could be used in outdoor environments, although not limited thereto. As shown in FIG. 1 one form of outdoor environment would be a cookout wherein a chafer frame 2 holds a pair of open top food containers 4,4. As better shown in FIGS. 4-7 the food container 4 is nestled in a lower open top container 6 which might hold, for example, water. Mounted on the frame are suitable heaters 8, such as sterno heaters, for maintaining the food in container 4 in a warm condition. This could be done by maintaining previously heated food in a warm condition or by heating the water in container 6 which in turn would maintain the food in container 4 hot. Conventional containers 4 and 6 are made of aluminum, although the invention is not limited to such containers.

A concern, which is addressed by the present invention, is that the open top food containers 4,4 in order to have the food accessible, are susceptible to flies or other insects getting into the food and otherwise causing annoyance. In accordance with this invention a cover 10 is provided to address this problem.

Cover 10 includes an outer frame having a peripheral imperforate side wall 12 having a sufficient size and height to be superimposed around the food containers 4. It is not necessary that the height of side wall 12 extend completely down the food containers 4. What is important is that the open tops of the food containers should be covered. By having the bottom of cover 10 completely open it is an easy matter to simply telescope the side wall 12 over the food containers. It is to be understood, however, that if desired an inward shoulder or ledge could be provided at the bottom of the periphery of side wall 12 for stability as long as the bottom of cover 10 is sufficiently open for the side wall 12 to telescope over the containers 4,4.

As shown in FIGS. 4-7 an inner frame 14 extends inwardly of side wall 12. The inner frame 14 extends completely around the inner surface of side wall 12. When cover 10 is telescoped over food container 4 the downward movement continues until inner frame 14 contacts the top edge or rim of food container 4.

Figure 2:
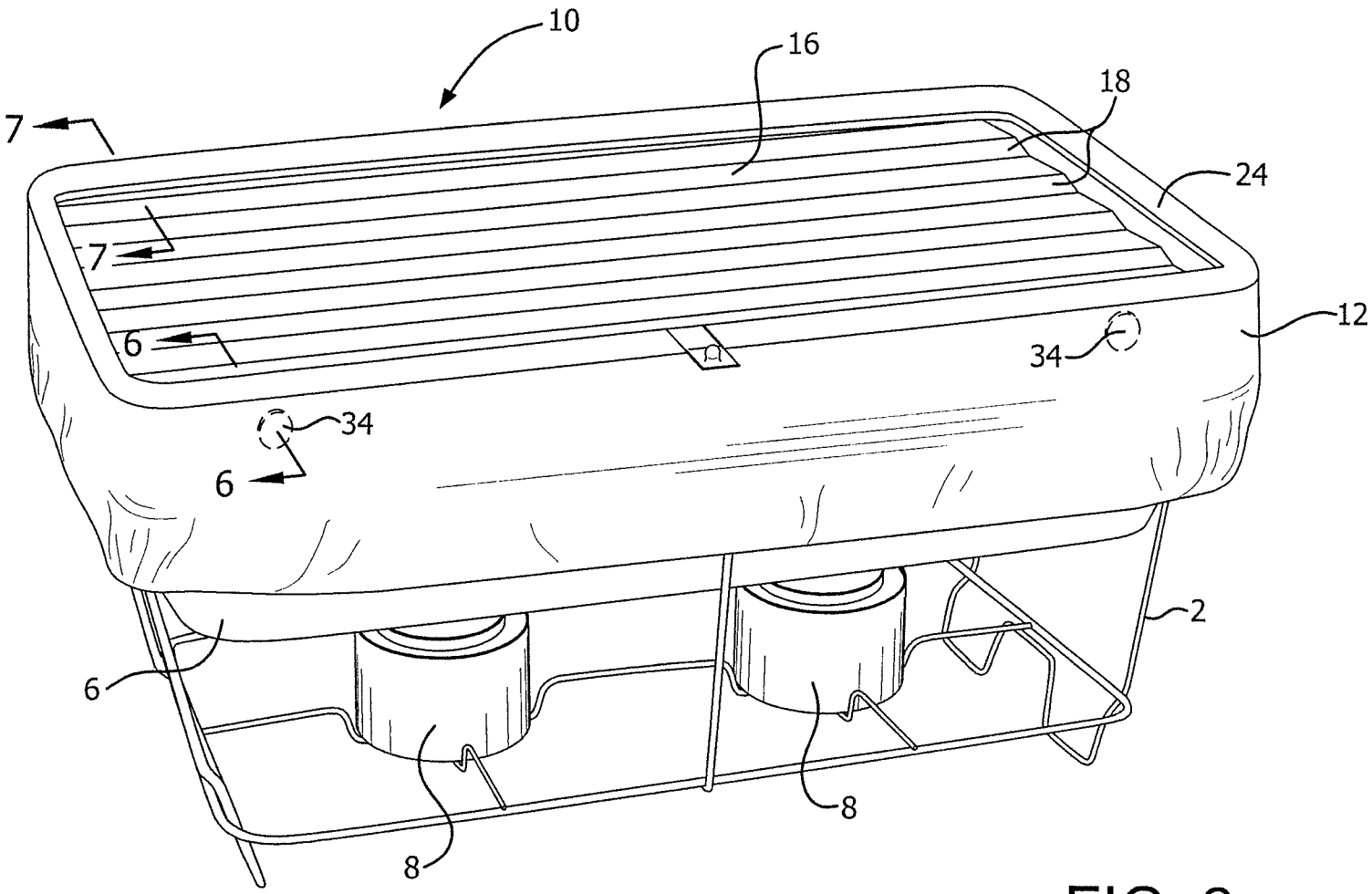
FIG. 2 is a perspective view similar to FIG. 1 showing the cover mounted in place with the lid in its closed condition.
Figure 3:
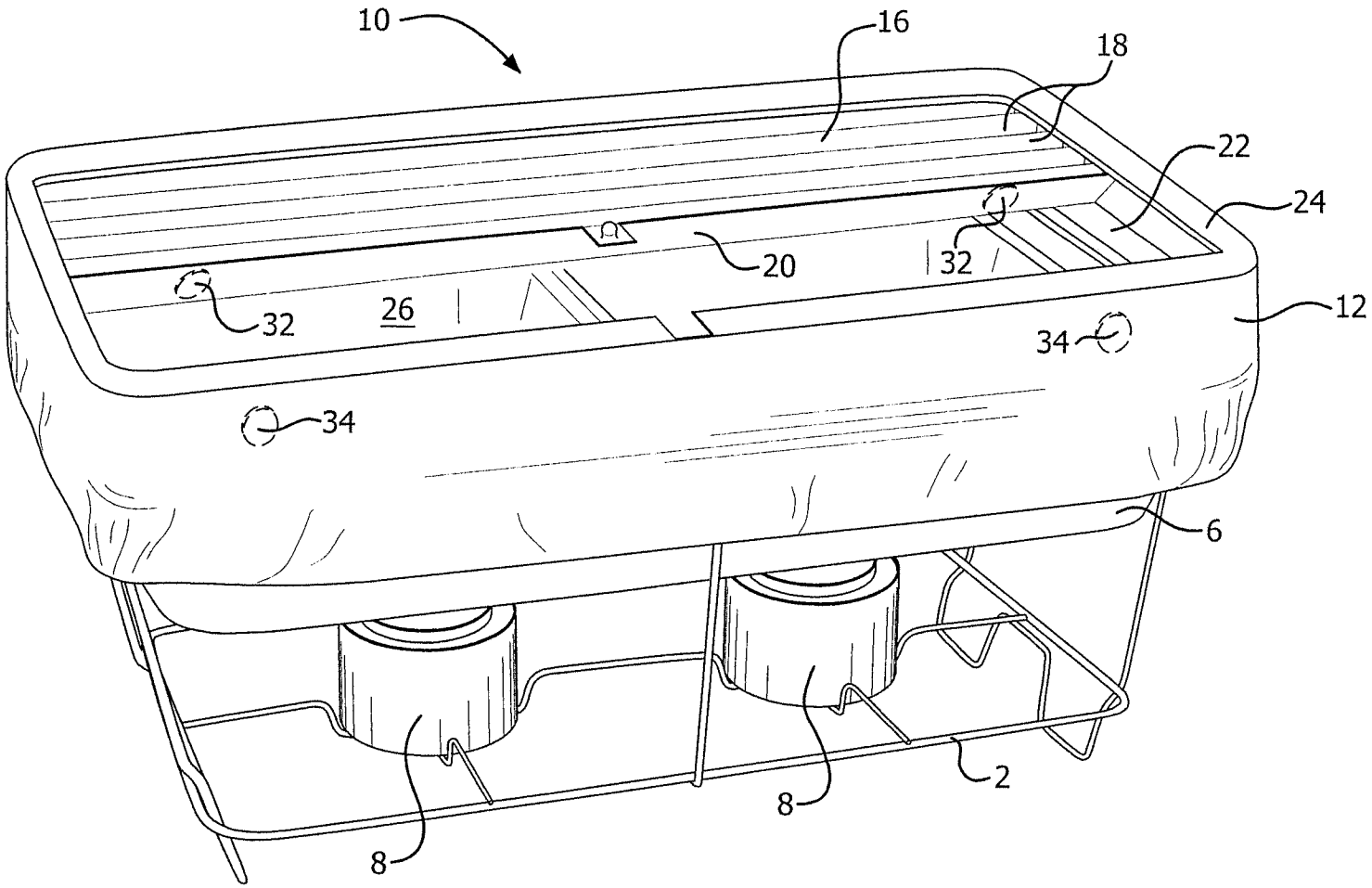
FIG. 3 is a view similar to FIG. 2 showing the lid partially open.

An important feature of this invention is the provision of a lid 16 which covers the open tops of the food containers 4,4. The lid is selectively movable to a completely open position and a completely closed position. FIG. 1, for example, shows the lid 16 where it is essentially open, while FIG. 2 shows the lid 16 completely closed. FIG. 3 also shows lid 16 partially open and partially closed.

Lid 16 is uniquely formed with a fan or accordion type structure wherein a plurality of identical slats 18 are sequentially pivotally mounted to each other along each upper edge and lower edge to form the fan/accordion type structure. The lead slat 20 may be conveniently gripped (and function as a handle) to move the lid to its retracted and to its extended conditions. The slats in lid 16 are imperforate so that when lid 16 is in its closed condition flies or other insects cannot penetrate the lid and are thus prevented from getting into the food containers 4.

As shown in FIGS. 2-3 and 8-9 lid 16 is of one piece structure wherein slats 18 are formed by uniformly bending or folding the structure upon itself to form the plurality of identical slats integrally mounted to each other along their resultant longitudinal edges.

Figure 5:
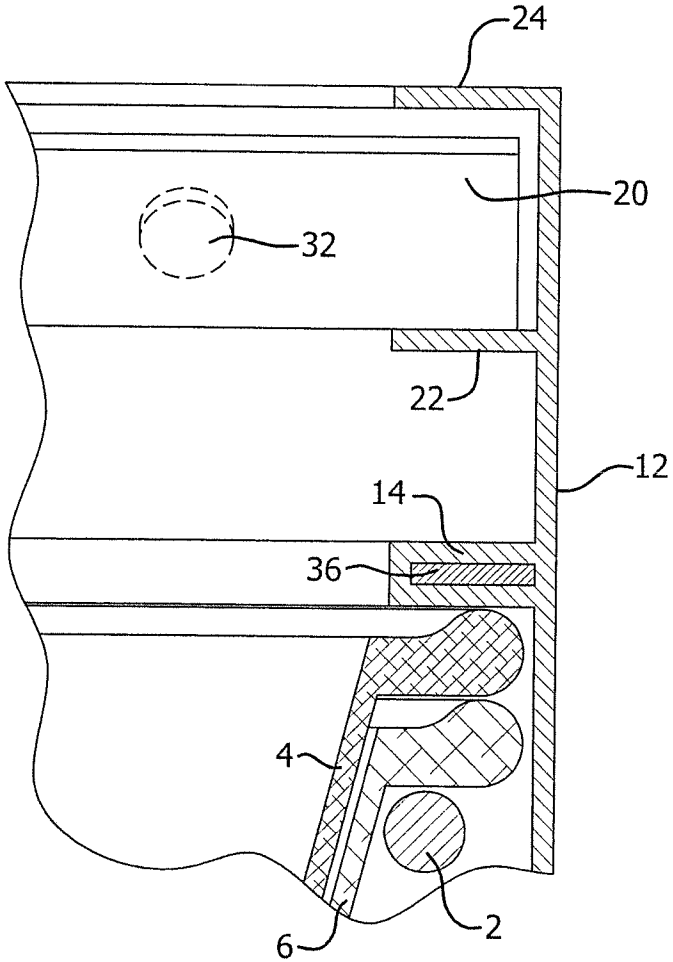
FIG. 5 is a cross-sectional view taken through FIG. 1 along the line 5-5 but with the cover mounted in place.
Figure 4:
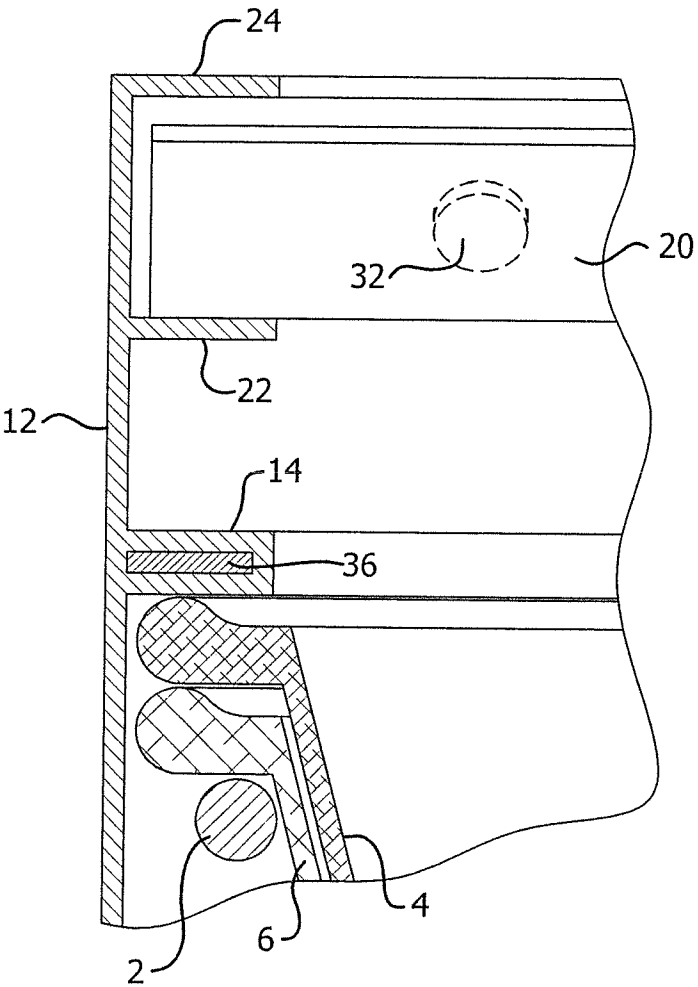
FIG. 4 is a cross-sectional view taken through FIG. 1 along line 4-4 but with the cover mounted in place.
Figure 7:
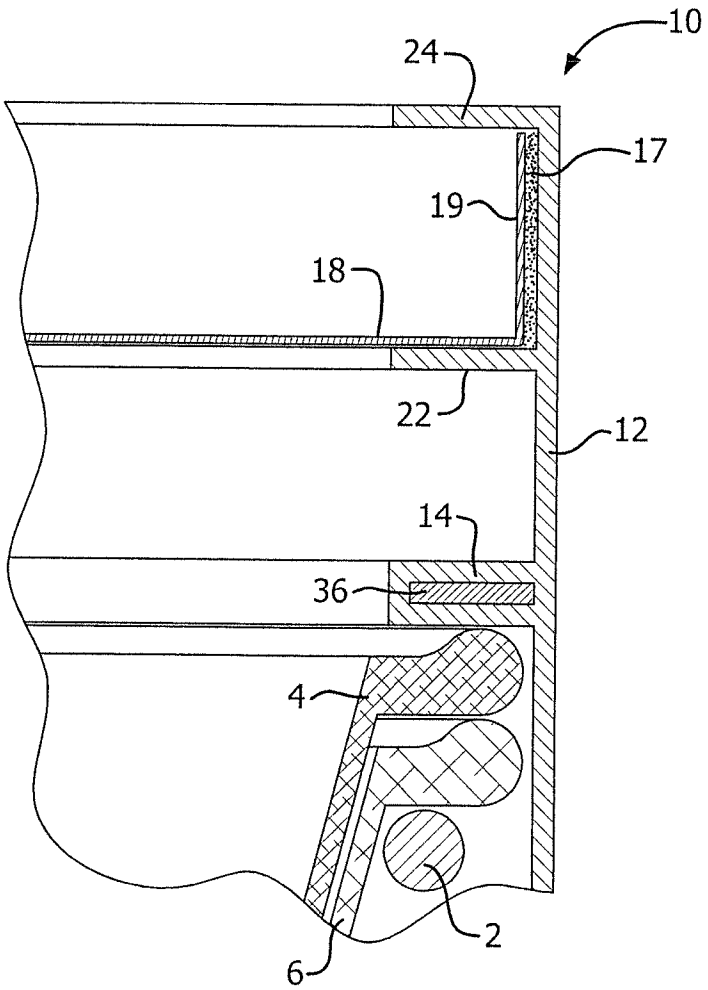
FIG. 7 is a cross-sectional view taken through FIG. 2 along the line 7-7.
Figure 6:
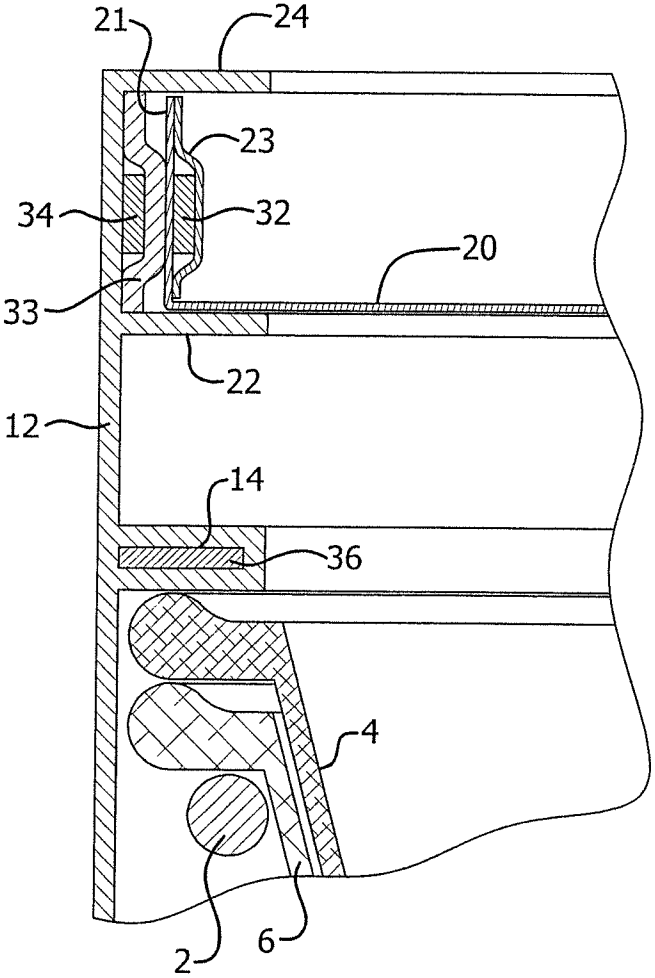
FIG. 6 is a cross-sectional view taken through FIG. 2 along the line 6-6.

As shown in FIG. 1 a support 22 is mounted on each of two opposite sides of side wall 12 upwardly from inner frame 14. Lid 16 rests on side supports 22,22 and in that sense the side supports 22,22 provide a track for lid 16 to slide in its opening and closing movements. FIGS. 4-5 show the condition of cover 10 when in the generally open position. As shown therein, lead slat 20 is generally vertically disposed. FIGS. 6-7 show the condition of cover 10 when in the fully closed position of FIG. 2. As shown therein, the slats 18,20 are generally horizontal.

A peripheral ledge 24 extends inwardly from the top of side wall 12. Ledge 24 assures lid 16 being maintained within the side wall 12. Thus, lid 16 is moved to its open and closed positions by being disposed between lower track or supports 22 and upper ledge 24. One end of lid 16 would be permanently anchored in any suitable manner at a slat remote from lead slat 20. FIG. 7, shows the slat 18 closest to wall 12 to have an upward extension 19 which is permanently anchored to side wall 12 by adhesive 17.

When lid 16 is in its open position, such as generally shown in FIG. 1, the open area 26 within side wall 12 provides ready access to the open top food containers 4,4. Thus, the fan/accordion structure of lid 16 conveniently permits the lid to be moved to its retracted position for exposing the cover to the food containers 4,4 (FIG. 1) or alternatively to its extended position which closes or prevents access to the food containers 4,4 (FIG. 2). When in its extended position lid 16 is preferably completely flat. Lid 16 is made to be wider and longer than the combined open areas of the food containers 4,4. In an exemplary cover 10 of this invention, side supports 22 are each 12.3 inches long and 1 inch wide. Inner frame 14 is 20.2 inches by 12.3 inches and has a ½ inch width. Lid 16 in its extended closed position would generally have the same length and width as the inner surface of wall 12. For example, in the exemplary embodiment side wall 12 is 4.1 inches high and its length and width are 13.4 inches by 20.2 inches. Lid 16 has a width of 18.8 inches. In its fully extended condition lid 16 has a length of 13 inches. In its fully retracted condition lid 16 has a length of ¾ inches. When the slats 18 of lid 16 are vertically disposed, their height is slightly less than the distance between supports 22 and ledge 24.

When lid 16 is moved to its closed position it is preferable to lock the lid in that position and thus assure no inadvertent opening of the lid to provide unintended access to the food containers 4,4. Any suitable locking structure could be used. FIGS. 1-3, for example, show a latch 28 on the lead slat 20. A cutout 30 is provided in ledge 24 to receive latch 28 and thereby permit the latch and cutout to cooperate as latch and complementary latch members in holding the lid 16 in its closed position. Other types of latch structure could also be used, such as having a hook on lead slat 20 which would hook over the side wall 12. The various figures also illustrate the provision of magnets 32 on lead slat 20 which would cooperate with magnets 34 on side wall 12. Such magnets could be disposed in any other arrangement such as by being on ledge 24 instead of the side wall itself.

FIG. 6 illustrates one manner of using magnetic locks as latch and complementary latch members. As shown therein lead slat 20 has an upward extension 21. Magnet 32 is mounted to extension 21 by a retainer member 23 which is secured to extension 21 to trap magnet 32 against extension 21. Similarly, magnet 34 is mounted to wall 12 by retainer member 33. When lid 16 is in the closed position of FIGS. 2 and 6 magnets 32 and 34 are disposed sufficiently near each other to latch lid 16 in the closed position.

Except for certain of its components, cover 10 is preferably made of a pliable material such as aluminum which is inexpensive and lends itself to the intended purposes of cover 10.

As shown in FIGS. 4-7 inner frame 14 may be aluminum material wrapped around a stiffener 36. Because of the pliability of inner frame 14, once the inner frame is located on the top edge of food container 4, inner frame 14 could be bent downwardly to provide an additional seal molded in place between cover 10 and the open top of food container 4. This would help assure that insects, for example, could not work their way into food container 4 from the bottom upwardly.

Figure 8:
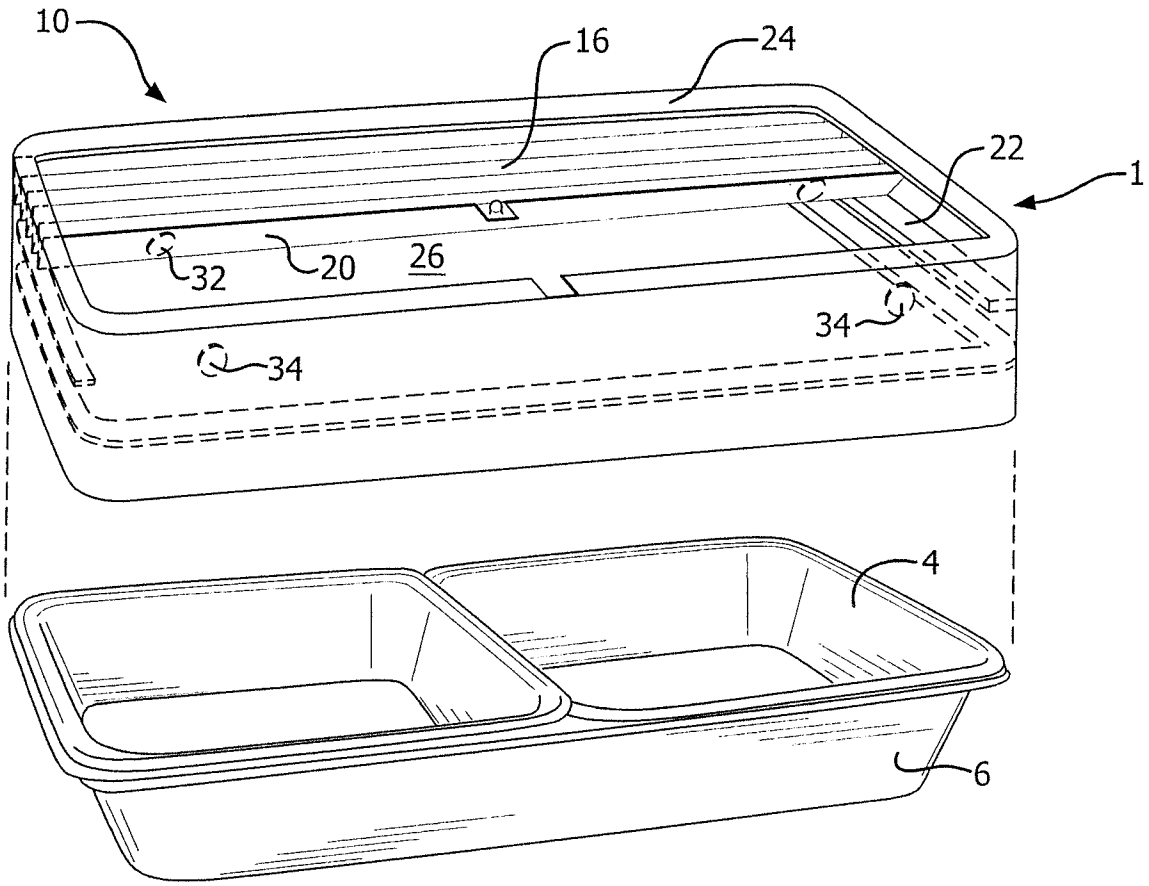
FIG. 8 is an exploded view showing the cover of this invention disposed over an alternative type of open top food containers.
Figure 9:
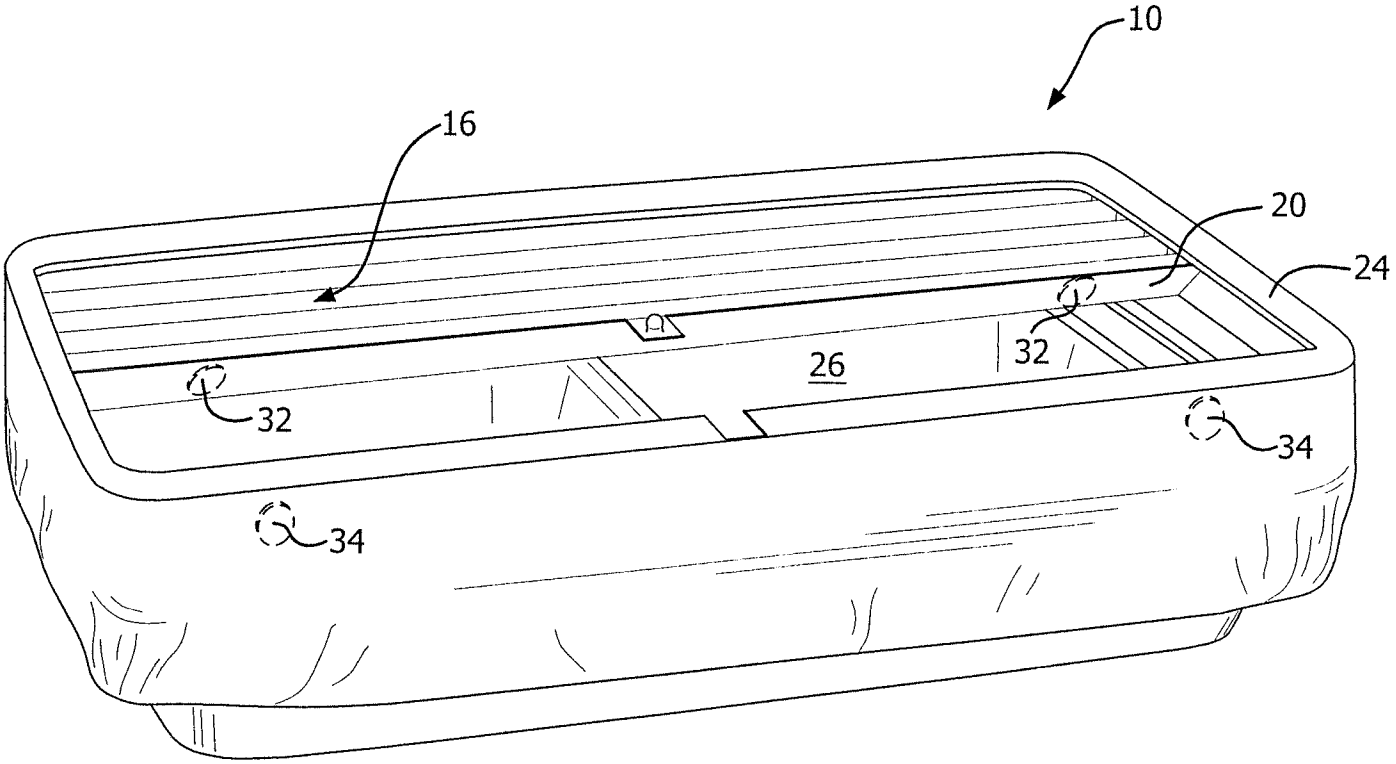
FIG. 9 is a perspective view showing the cover of FIG. 8 mounted in place over the food containers.

While FIGS. 1-7 show cover 10 used with food containers 4,4 on a chafer frame 2 the invention is not limited to such use. Instead, it is to be understood that the cover 10 could be used for covering any other type of container. FIGS. 8-9, for example, show cover 10 where it would be placed over one or more open food containers 4 that would be placed directly on a table or other support surface, such as a shelf. It is also to be understood that the cover need not be used to cover plural food containers, but could be used for single food containers with or without lower water containers. The cover 10 could be used multiple times or could have single use. A single use is particularly preferred where it is intended to bend or mold the inner frame 14 to make intimate contact with the upper edge of the food container. While the inner frame 14 could then be unbent for multiple use, cover 10 could be inexpensive enough for only single use.

Preferably, the side wall 12, the inner frame 14 and the lid 16 are all made of imperforate material to minimize any chance of flies or other insects penetrating those components. While aluminum is the preferred material for cover 10, the invention could be practiced with other materials, such as metals or plastics. Some of the key features of the invention are a lid provided in the cover to selectively open and close access to the food container. The lid has fan/accordion structure for accomplishing this task. An inner frame is also desired to provide a further seal against the upper edge of the food container. Thus, by bending the upper frame, the upper frame becomes molded to fit the shape of the container below it. The use of an anchored fan/accordion lid is particularly beneficial in that it occupies the minimum amount of space necessary to open/close access to the food container and is easy to operate as well as to maintain in a closed condition.

An advantage of inner frame 14 is that it functions as a spacer for lid 16. When viewed vertically, first the upper edge of cover 10 has the ledge 24 on side wall 12. Then below ledge 24 is lid 16 which slides on the track provided by side supports 22. Side supports 22 are of sufficient length to support the lid 16 throughout its movements. Preferably side supports 22 are mounted to the short sides of wall 12 extending from one long side on the inner surface of wall 12 to the opposite long side. Below side supports 22 is inner frame 14. The advantage of inner frame 14 spacing lid 16 above the upper edge of container 4 is that such spacing assures that the upper edge of the container and/or food items extending above the upper edge of the container will not interfere with the sliding movement of lid 16.

Lid 16 could be made of any suitable material. Preferably the slats 18 are parallel to each other and are of identical size, shape and material. Such material could be relatively stiff or could have some flexibility. The main concern is that in its extended condition the lid should provide an effective cover protecting the food in the containers 4.

If desired, slats 18 could be made of sufficiently heavy material or various spaced slats could include weights to assure that lid 16 is maintained in a flat condition when in its extended covering position.

While the invention has been particularly described with regard to controlling the access to food in open food containers it is to be understood that the invention is not limited to such use. The invention could be broadly practiced for covering any item where selective access to that item is desired.

What is claimed is:

1. A cover for selective access to an open top food container comprising a peripheral side wall for telescoping over and surrounding the container for the detachable mounting of said cover to the container, said cover having an open area bottom to permit said wall to be lowered over the container, said cover having an open area at its top to permit access to the container through said side wall from the cover top open area, a lid for selectively opening and closing said top open area, said lid being of fan/accordion structure comprising a plurality of slats having longitudinal edges pivotally connected along said longitudinal edges, said fan/accordion structure comprising a single sheet of material repeatedly folded to create said plurality of slats along said longitudinal edges, said slats being integral with each other at said longitudinal edges, said lid being slidable in a horizontal direction to selectively move to and from retracted and extended conditions, said lid exposing said top open area to provide access to the container when said lid is in said retracted condition, said lid being entirely in a horizontal orientation when said lid is in said extended condition and said retracted condition, and said lid closing said top open area to cover the container when said lid is in said extended condition.

2. The cover of claim 1 including an inner frame mounted to an inner surface of said side wall extending inwardly from said side wall and located below said lid, and said inner frame being capable of being disposed on a food container to space said lid from the food container.

3. The cover of claim 2 including a side support mounted to opposite sides on the inner surface of said side wall, and said lid being slidably mounted on said side supports whereby said side supports function as a track for said lid.

4. The cover of claim 3 including an inwardly extending ledge mounted to a top of said side wall peripherally around said side wall and disposed above said lid to confine said lid between said ledge and said side supports.

5. The cover of claim 4 wherein one of said plurality of slats of said lid includes a lead slat and a remote slat which is remote from said lead slat, said lead slat functioning as a handle for sliding said lid to its retracted and extended conditions, and said slat remote from said lead slat being anchored to said side wall.

6. The cover of claim 5 including a latch mechanism for holding said lid in its extended closing position, and wherein said latch mechanism includes a latch member on said lead slat and a complementary latch member on said side wall.

7. The cover of claim 6 wherein said latch member and said complementary latch member are magnets.

8. The cover of claim 6 wherein said latch member is a structure mounted to said lead slat, and said complementary latch member being a cutout in said ledge.

9. The cover of claim 3 including a latch mechanism for holding said lid in its extended closing position.

10. The cover of claim 3 wherein one of said plurality of slats of said lid includes a lead slat and a remote slat which is remote from said lead slat, said lead slat functioning as a handle for sliding said lid to its retracted and extended conditions, and said slat remote from said lead slat being anchored to said side wall.

11. The cover of claim 2 wherein said side wall and said inner frame and said lid are made of imperforate material.

12. The cover of claim 1 in combination with a food container, an inner frame on said side wall disposed on an upper edge of said food container, said cover being telescoped over and surrounding a top portion of said food container for detachable mounting to the food container by being mounted to said food container by the inner frame being on the upper edge of the food container.

13. The combination of claim 12 wherein there are multiple food containers covered by said lid, and said side wall terminating above the bottoms of said food containers.

14. A cover for selective access to an open top food container comprising a peripheral side wall for telescoping over and surrounding the container, said cover having an open area bottom to permit said wall to be lowered over the container, said cover having an open area at its top to permit access to the container through said side wall from the cover top open area, a lid for selectively opening and closing said top open area, said lid being of fan/accordion structure comprising a plurality of slats having longitudinal edges pivotally connected along said longitudinal edges, said lid being slidable to selectively move to and from retracted and extended conditions, said lid exposing said top open area to provide access to the container when said lid is in said retracted condition, said lid closing said top open area to cover the container when said lid is in said extended condition, an inner frame mounted to an inner surface of said side wall extending inwardly from said side wall and located below said lid, said inner frame being capable of being disposed on a food container to space said lid from the food container, a side support mounted to opposite sides on the inner surface of said side wall, said lid being slidably mounted on said side supports whereby said side supports function as a track for said lid, and said inner frame being made of a pliable material capable of being molded to an upper edge of a food container.

* * * * *